United States Patent [19]

Ciarico

[11] 3,977,551

[45] Aug. 31, 1976

[54] SPECIMEN RECEPTACLE

[75] Inventor: Anthony J. Ciarico, Cary, Ill.

[73] Assignee: The Kendall Company, Boston, Mass.

[22] Filed: Nov. 10, 1975

[21] Appl. No.: 630,107

[52] U.S. Cl. ..... 215/1 C; 220/82 R

[51] Int. Cl.[2] ..... B65D 25/54

[58] Field of Search ..... 215/1 C, 1 R; 220/82 R, 220/82 A; 222/156, 157

[56] References Cited

UNITED STATES PATENTS

| | | | |
|---|---|---|---|
| 1,161,012 | 11/1915 | Summers | 220/82 R X |
| 3,107,805 | 10/1963 | Asher | 215/1 C UX |
| 3,926,324 | 12/1975 | Zavasnik | 215/1 C |

*Primary Examiner*—Donald F. Norton
*Attorney, Agent, or Firm*—Powell L. Sprunger

[57] ABSTRACT

A specimen receptacle comprising, a container having a chamber for retaining the specimen, and a transparent lower end portion of reduced dimensions defining a lower end of the chamber of reduced configurations for collecting sediment from the specimen. The receptacle has a skirt depending from the container and having a lower end edge located at least as low as the bottom of the lower end portion to support the container in an upright position. The container has a cutout portion in alignment with the lower end portion to permit unobscured vision of collected sediment in the lower end portion.

13 Claims, 5 Drawing Figures

SPECIMEN RECEPTACLE

BACKGROUND OF THE INVENTION

The present invention relates to receptacles, and more particularly to specimen containers.

As a part of certain medical procedures, specimens of body fluid, such as cerebrospinal fluid, are collected in a container, after which the container is placed in a centrifuge. The container and specimen are then subjected to forces by the centrifuge in order to settle out any sediment in the specimen. This procedure thus determines whether such sediment may be present in the specimen, and, if present, the sediment may be subjected to analysis in connection with possible treatment for the patient. In the past, it has been relatively difficult to clearly see such collected sediment through the particular containers utilized, and thus to determine whether such sediment is present in the specimen.

SUMMARY OF THE INVENTION

A principal feature of the present invention is the provision of a receptacle of simplified construction for use in centrifuging specimens of body fluid.

The receptacle of the present invention comprises, a container having a chamber for retaining the specimen and a transparent lower end portion of reduced dimensions defining a lower end of the chamber of reduced configurations. The receptacle has a skirt depending from the container and having a lower end edge located at least as low as the bottom of the lower end portion. The skirt has a cut-out portion in alignment with the lower end portion.

A feature of the invention is that sediment from the centrifuged specimen settles out and collects in the lower end portion of the container.

Another feature of the invention is that the skirt supports the container in an upright position when its lower end edge is placed on a supporting surface.

Yet another feature of the invention is that the cut-out portion permits unobscured vision of the container lower end portion.

Thus, a feature of the invention is that the sediment may be clearly observed through the cut-out portion and transparent lower end portion without obstruction by the skirt.

Further features will become more fully apparent in the following description of the embodiments of this invention and from the appended claims.

DESCRIPTION OF THE PREFERRED EMBODIMENTS

Figure 1:
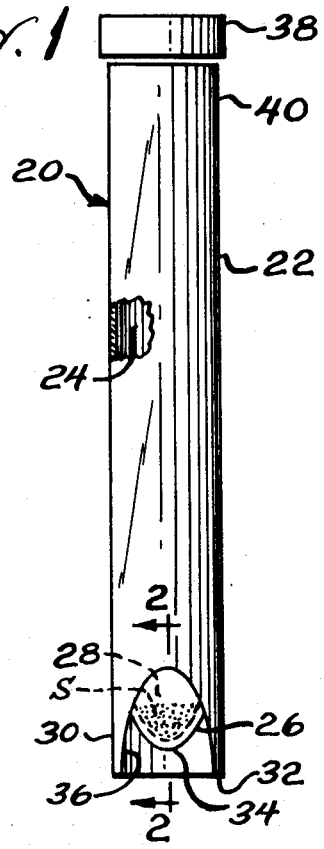
FIG. 1 is an elevational view of a specimen receptacle of the present invention.
Figure 3:
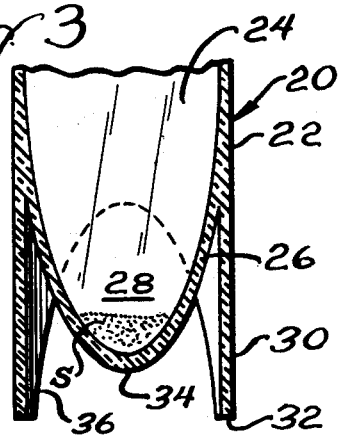
FIG. 3 is a fragmentary sectional view, taken substantially as indicated along the line 3—3 of FIG. 2.
Figure 2:
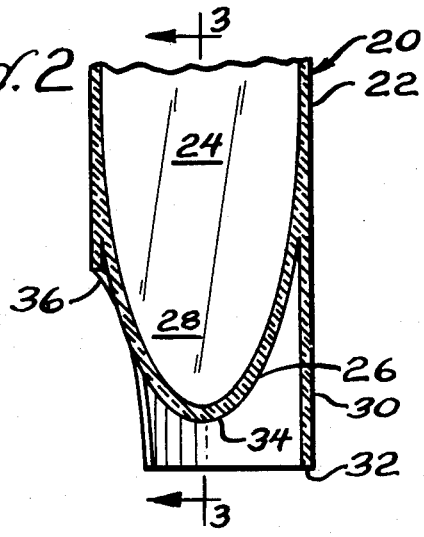
FIG. 2 is a fragmentary elevational view, taken partly in section substantially as indicated along the line 2—2 of FIG. 1.

Referring now to FIGS. 1–3, there is shown a centrifuge receptacle generally designated 20 for retaining a specimen, such as cerebrospinal fluid. The receptacle 20 has an elongated transparent container or tubular member 22 defining a chamber 24 for retaining the specimen, and may be made of any suitable material, such as styrene. The container 22 has a transparent tapered or generally conical shaped lower end portion 26 which defines a lower end 28 of the chamber 24 of reduced configurations. After the specimen has been collected in the receptacle chamber 24, the specimen and container 22 may be subjected to forces by a centrifuge. As a result, sediment S, which may be contained in the specimen, settles out from the specimen and collects in the lower end 28 of the chamber 24.

The container 22 has a depending skirt 30 which extends at least partially around the lower end portion 26 of the container 22. The skirt 30 has a lower end edge 32 which is located at least as low as the bottom 34 of the container lower end portion 26, and is preferably located at a position below the lower end portion bottom 34. Thus, the lower end edge 32 of the skirt 30 may be placed on a supporting surface, such that the skirt 30 supports the container 22 in an upright position.

As shown, the skirt 30 has a cut-out portion 36 which is aligned with the lower end portion 26 of the container 22. In the particular embodiment shown in FIGS. 1–3, the cut-out portion 36 comprises an arcuate or elliptical opening extending from the lower end edge 32 of the skirt 30 upwardly along the container. Thus, after the specimen has been subjected to forces in the centrifuge, the receptacle may be supported by the skirt 30 in an upright position while the sediment S, if any, collects in the lower end portion 26 of the container 22. After the appropriate settling time for the sediment, the lower end 28 of the chamber 24 may be readily viewed through the cut-out portion 36, which permits unobscured vision of such sediment through the transparent lower end portion 26. Accordingly, the user may readily determine whether sediment from the specimen has collected in the container, and thus whether such sediment may exist for further analysis.

In a convenient form, as shown, the container 22 and skirt 30 may be formed as a tube, and the lower end portion 26 of the container 22 may be formed as an integral part thereof, with the lower end portion 26 being located inside a lower end section defining the skirt of the tube. Also, the container 22 may have a cap 38 releasably attached to its top 40 by suitable means, such as by threads or by a friction fit.

Figure 4:
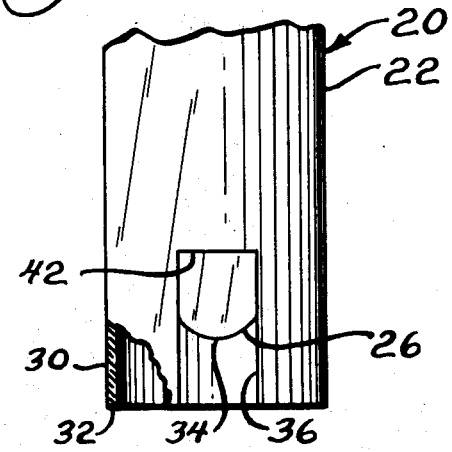
FIG. 4 is a fragmentary elevational view, taken partly in section, of another embodiment of a receptacle of the present invention.
Figure 5:
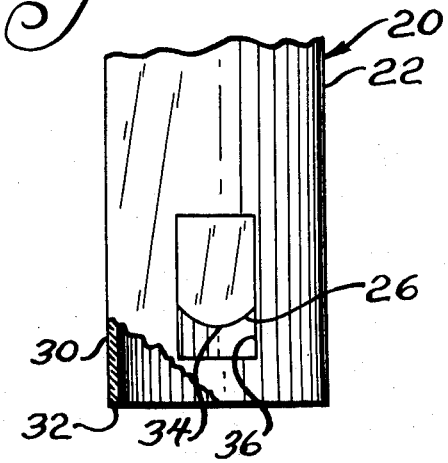
FIG. 5 is a fragmentary elevational view, taken partly in section, of another embodiment of a receptacle of the present invention.

Another embodiment of the receptacle of the present invention is illustrated in FIG. 4, in which like reference numerals designate like parts. In this embodiment, the cut-out portion 36 comprises an elongated slot which extends from the lower end edge 32 of the skirt 30 upwardly along the container 22. As shown, an upper end 42 of the slot 36 is in alignment with the lower end portion 26 of the container 22 to permit unobscured vision of sediment in the lower end portion 26. As shown in FIG. 5, the cut-out portion 36 may comprise a window in the skirt which is spaced from the lower end edge 32 of the skirt 30 and being aligned with the lower end portion 26 of the container 22. The cut-out portion may have any suitable shape, as desired, to permit clear vision of the sediment in the lower end portion 26 of the container 22, while the skirt supports the container in an upright position.

The foregoing detailed description is given for clearness of understanding only, and no unnecessary limitations should be understood therefrom, as modifications will be obvious to those skilled in the art.

I claim:

1. A specimen receptacle comprising, a container having a chamber for retaining the specimen, a transparent lower end portion of reduced dimensions defining a lower end of the chamber of reduced configurations for collecting sediment from the specimen, and a skirt depending from the container and having a lower end edge located at least as low as the bottom of said lower end portion to support the container in an upright position, said skirt having a cut-out portion in alignment with said lower end portion to permit unobscured vision of collected sediment in the lower end portion.

2. A specimen receptacle, comprising:

an elongated transparent tubular member defining a chamber for retaining the specimen, said tubular member having a tapered lower end portion defining a lower end of said chamber of reduced configurations for collecting sediment from the specimen; and a skirt depending from said tubular member and having a lower end edge located at least as low as the bottom of said lower end portion, said skirt extending around said lower end portion a sufficient distance to support the tubular member in an upright position, said skirt having a cut-out portion in alignment with said lower end portion to permit unobscured vision of collected sediment in the lower end portion.

3. The receptacle of claim 2 wherein said skirt has a generally tubular shape.

4. The receptacle of claim 2 wherein said skirt is integral with said tubular member.

5. The receptacle of claim 2 wherein said skirt is transparent.

6. The receptacle of claim 2 wherein said lower end portion has a generally arcuate shape.

7. The receptacle of claim 2 wherein said cut-out portion extends from the lower end edge of said skirt.

8. The receptacle of claim 7 wherein said cut-out portion is tapered upwardly along the skirt.

9. The receptacle of claim 8 wherein said cut-out portion has a generally arcuate shape.

10. The receptacle of claim 7 wherein said cut-out portion comprises a slot.

11. The receptacle of claim 2 wherein said cut-out portion comprises a window in said skirt spaced from said lower end edge.

12. The receptacle of claim 2 wherein said lower end edge is located below the bottom of said lower end portion.

13. A specimen receptacle comprising, an elongated transparent tube defining a chamber for retaining the specimen, said tube having a lower end edge and a tapered lower end portion located inside a lower end section of the tube extending from said lower end edge, with the bottom of said lower end portion being spaced above said lower end edge and defining a lower end of the chamber of reduced configurations for collecting sediment from the specimen, said lower end section having a cut-out portion in alignment with said lower end portion to permit unobscured vision of collected sediment in the lower end portion.

* * * * *